United States Patent [19]

Krafft et al.

[11] 4,379,829

[45] Apr. 12, 1983

[54] PHOTOGRAPHIC MATERIAL CONTAINING A TEMPORARY BARRIER LAYER APPLIED FROM AN ORGANIC SOLUTION

[75] Inventors: Werner Krafft, Leverkusen; Günter Helling, Cologne; Güunther Matschke, Leverkusen; Immo Boie, Langenfeld, all of Fed. Rep. of Germany

[73] Assignee: Agfa-Gevaert Aktiengesellschaft, Leverkusen, Fed. Rep. of Germany

[21] Appl. No.: 222,087

[22] Filed: Jan. 2, 1981

[30] Foreign Application Priority Data

Jan. 4, 1980 [DE] Fed. Rep. of Germany ..... 3000193

[51] Int. Cl.[3] ..... G03C 1/40; G03C 5/54; G03C 7/00

[52] U.S. Cl. ..... 430/215; 430/221; 430/236; 430/536

[58] Field of Search ..... 430/213, 215, 221, 236, 430/237, 536

[56] References Cited

U.S. PATENT DOCUMENTS 4,199,362 4/1980 Yoshida et al. ..... 430/215

4,229,516 10/1980 Abel ..... 430/215

4,250,243 2/1981 Yoshida et al. ..... 430/215

*Primary Examiner*—John E. Kittle

*Assistant Examiner*—John L. Goodrow

*Attorney, Agent, or Firm*—Connolly and Hutz

[57] ABSTRACT

A color photographic material for the dye diffusion transfer process contains a temporary barrier layer that is applied from organic solution and consists of a mixture of (a) 40 to 95% by weight of a copolymer of 40 to 80% by weight of monomer I (vinylidene chloride, dimethyl butadiene or dichlorobutadiene) 18 to 50% by weight of monomer II ((meth)acrylonitrile or alkyl (meth)acrylate) and 2 to 10% by weight of monomer III (olefinically unsaturated copolymerizable mono or dicarboxylic acids, sulfonic acids or phosphonic acids) and (b) 5 to 60% by weight of a homopolymer of alkyl acrylate, hydroxyalkyl acrylate, N-alkyl acrylamide, N-hydroxyalkyl acrylamide vinyl acetate, or polycarbonate or cellulose acetate, or a copolymer of 80 to 99% by weight of alkyl or hydroxyalkyl acrylate and 1 to 20% by weight of a copolymerizable acid.

5 Claims, 1 Drawing Figure

Figure 1:
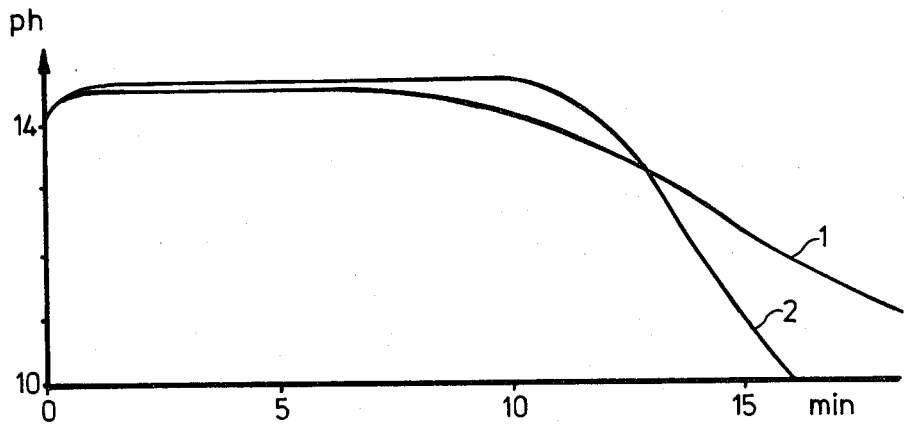

PHOTOGRAPHIC MATERIAL CONTAINING A TEMPORARY BARRIER LAYER APPLIED FROM AN ORGANIC SOLUTION

This invention relates to a photographic material for the dye diffusion transfer process containing a temporary barrier layer consisting of a mixture of at least two polymers applied from an organic solution.

It is known to use intermediate layers in multilayered photographic materials, in particular in light-sensitive color photographic materials, in order to keep the development processes taking place in the different layers separate from each other in space. These intermediate layers are generally layers of a hydrophilic binder which is permeable to the developer alkali, in particular a binder such as gelatine.

It is also known to use intermediate layers having a temporary barrier action in photographic materials in order to ensure that the various development processes will take place at different times in the different layers. Such temporary barrier layers are particularly important in color photographic recording materials for the dye diffusion transfer process which contain color providing compounds such as, for example, the so-called dye developers which have a certain mobility in the alkaline developer medium and are only immobilized immagewise in the areas where development takes place.

Auxiliary layers which exert a temporary barrier action on aqueous alkalines are also used in combination with a layer containing an acid polymer to form a so-called neutralization system. After expiry of the required development time, the acid polymer layer lowers the pH in the photographic material which is to be developed to a value at which development is effectively stopped. The temporary barrier layer delays the lowering of the pH to a certain extent so that development is not stopped prematurely. The use of temporary barrier layers in combination with an acid polymer layer as a so-called neutralization system has been disclosed in, for example, U.S. Pat. Nos. 2,584,030; 2,607,685; 3,419,389; 3,433,633; 3,362,819; 4,088,493 and 4,138,260 and German Offenlegungsschrift No. 2,716,505.

In order to achieve satisfactory development of the color photographic recording material over a comparatively wide temperature range, the barrier effect of the temporary barrier layers should be dependent upon temperature in the sense that at higher temperatures, at which development is more rapid, the barrier action stops sooner than at normal temperature. Conversely, at lower temperatures, the barrier action of the temporary barrier layer should be more prolonged. Furthermore, the barrier function of the layer should be such that the barrier action at the temperature at which development is carried out should be completely maintained for as long a period as possible and should then drop rapidly so that the layer becomes completely permeable to aqueous alkali.

One problem which has not hitherto been solved satisfactorily is that the temporary barrier layer, which may consist of various polymers prepared by emulsion polymerisation and is cast on the acid polymer layer in the form of a latex, produces a layer of only poor quality on this polymer layer.

It is an object of this invention to provide new temporary barrier layers for photographic materials which have the desired temporary barrier effect and can be applied from an organic solution, preferably directly to a polymer acid layer.

This invention therefore relates to a photographic material for the dye diffusion transfer process having at least one temporary barrier layer arranged between two layers which are permeable to alkali, characterised in that the temporary barrier layer consists of a mixture applied from an organic solution, of (a) 40 to 95% by weight, preferably 40 to 80% by weight, of a copolymer of 40 to 80% by weight, preferably 55 to 75% by weight, of at least one comonomer I selected from the group consisting of vinylidene chloride, dimethyl butadiene and dichlorobutadiene; 18 to 50% by weight, preferably 21 to 37% by weight, of at least one comonomer II selected from the group consisting of (meth)-acrylonitrile and alkyl (meth)-acrylate and 2 to 10% by weight, preferably 4 to 8% by weight, of at least one comonomer III selected from the group consisting of olefinically unsaturated copolymerisable mono or dicarboxylic acids, sulfonic acids and phosphonic acids, and (b) 5 to 60% by weight, preferably 20 to 60% by weight, of a homopolymer selected from the group consisting of poly-(alkyl acrylate), poly-(hydroxy alkyl acrylate), polycarbonate, poly-(N-alkyl acrylamide), poly-(N-hydroxy alkyl acrylamide), poly-(vinyl acetate) and cellulose acetate, or of a copolymer of from 80 to 99% by weight of alkyl acrylate or hydroxy alkyl acrylate and from 1 to 20% by weight of an olefinically unsaturated copolymerisable mono or dicarboxylic acid, sulfonic acid or phosphone acids.

According to the invention, advantageous results are obtained if, firstly, not only a certain polymer but a mixture of a first polymer and a second polymer is used as indicated above all, secondly, the mixture is applied from organic solution.

The first polymer is a copolymer built up of at least one of each of the comonomers, I, II and III. It may be prepared by known methods, for example by emulsion polymerisation, in which case it precipitates in the form of a latex, or by precipitation or solution polymerisation.

The alkyl (meth)acrylate mentioned as example of the comonomer II o the first polymer is an alkyl ester of acrylic acid or methacrylic acid in which the alkyl group preferably has from 1 to 4 carbon atoms. Examples include methyl acrylate, ethyl acrylate, butyl acrylate and butyl methacrylate.

The following are specific examples of the copolymerisable acids used as comonomer III of the first polymer and optionally as comonomer of the second polymer: (meth)acrylic acid, itaconic acid, maleic acid $\beta$-acroyloxy-propionic acid, vinylphosphonic acid, vinylsulfonic acid, styrene sulfonic acid, 2-acrylamido-2-methyl-propane sulfonic acid, sulfoethyl methacrylate and sulfopropyl acrylate.

In the poly-(alkyl acrylates), poly-(hydroxy alkyl acrylates), poly-(N-alkylacrylamides) and poly-(N-hydroxy alkyl acrylamides) which are homopolymers mentioned as examples of the second polymer, the alkyl group preferably has from 1 to 4 carbon atoms.

The polycarbonates are understood to be substantially linear condensation polymers having the characteristic group O-CO-O as connecting link between organic groups.

The cellulose acetate mentioned as example of the second polymer may be completely or partially acetylated. Cellulose acetate having a degree of acetylation of about 40%, for example, is found to be particularly suitable.

The homopolymers of the second polymer are commercially available substances and the copolymers of the second polymer may, like the terpolymer of the first polymer, be prepared by emulsion polymerisation or solution polymerisation from the corresponding comonomers.

According to the invention, the mixture of the first polymer and the second polymer is applied from organic solution. This means that the mixture of the two polymers are cast as solution in an organic solvent to form a layer from which the solvent is evaporated off. A preferred organic solvent is methyl ethyl ketone.

If the polymers are obtained as a latex, they may be worked up in known manner by precipitation and drying, e.g. by spray drying, and then taken up in the organic solvent.

It is found that temporary barrier layers prepared in this manner can readily be cast, particularly if they are applied directly to an acid polymer layer to form the neutralisation system with this layer. The temporary barrier layers according to the invention also have the desired temperature dependent temporary barrier action for aqueous alkali, and the temperature gradient of the barrier action on aqueous alkali can be adjusted within wide limits by altering the proportions of the mixture.

The following test may be used to determine suitable temporary barrier layers:

A support layer of polyethylene terephthalate is first coated with a polymeric acid layer of, for example, a copolymer of 70 parts by weight of acrylic acid and 30 parts by weight of butyl acrylate applied from organic solution, and dried. The temporary barrier layer which is to be tested is thereupon also applied from organic solution and dried. The test sheet obtained in this way is then brought into contact with an uncoated transparent polyethylene terephthalate foil as cover sheet through two spacer strips each 130 μm in thickness arranged at the side of the sheets, the contact being made with the active surface of the barrier layer. A viscous alkali solution with pH indicator is then distributed between the two sheets in known manner, using two squeezing rollers. The alkaline indicator solution may, for example, have the following composition:

5 g of KOH, 3,5 g of hydroxyethyl cellulose, e.g. natrosol HHR of Hercules, 0.1 g of thymolphthalein, made up with water to 100 ml.

After a certain barrier time, rapid decolorization of the layer of paste sets in spontaneously. The average time between the beginning and completion of decolorization of the paste is defined as the "EZ value" (EZ=Entrfärbungszeit=decolorization time) measured in minutes. The temperature gradient of the barrier action of the temporary barrier layer under investigation can easily be determined from the difference between the EZ values measured at different temperatures. The so-called activation energy Ea is a measure of the temperature gradient required. It can be determined from the straight line part of a curve in kcal per mol, in which the EZ values found are plotted on a logarithmic scale depending upon the reciprocal temperature, using the following equation:

$$Ea = 0.00458 \cdot \frac{\log EZ_2 - \log EZ_1}{\frac{1}{T_2} - \frac{1}{T_1}}$$

Barrier layers with suitable temporary barrier characteristics have an activation energy of from 15 to 30 kcal per mol. Temporary barrier layers according to the invention having exceptionally advantageous characteristics and good stability in storage may be obtained by using, for example, a mixture of a first polymer of vinylidene chloride, methyl acrylate and itaconic acid and polyethyl arcylate as second polymer; in such a mixture, the activation energy can be controlled within wide limits by adjusting the proportions in which the two polymers are mixed.

The temporary barrier layer according to the invention may be used in various forms in color photographic materials. For example, it may be used between two light-sensitive silver halide emulsion layers in order that the development proces may take place at different times in the two silver halide emulsion layers. This form of using the barrier layer is particularly important when so-called dye developers are used as color providing compounds. These are well known to be compounds which are mobile in an aqueous alkaline medium and are immobilized imagewise as a result of development. They contain, in one and the same molecule, a chromophoric group which is responsible for providing the image color and a developer function which serves to effect imagewise immobilization. Due to the presence of the developer function, which is a reactive group, the dye developers are capable of reacting when they diffuse through silver halide emulsion layers with which they are not associated and in which development has not yet been completed and they may then be fixed in these layers, with the result that in the transfer image unsufficient image color densities are obtained and the color equilibrium is shifted. By using the temporary barrier layers according to the invention, it is possible to ensure that, in certain silver halide emulsion layers, the high pH required for development will only be reached after development in other silver halide emulsion layers situated along the diffusion path of the still mobile dye developer has already been substantially completed.

Photographically active compounds such as, for example, silver halide development inhibitors, may be embedded in such temporary barrier layers to be released only when the barrier effect dies down, i.e. with a certain delay.

Another use of the temporary barrier layers, which is particularly preferred according to the invention, concerns the combination with so-called acid polymer layers to form a combined neutralisation system. Such a combined neutralisation system may be arranged, for example, on a separate image receiving sheet for the dye diffusion transfer process if the image receiving sheet is to be separated from the light-sensitive material after development. Such an image receiving sheet comprises in addition to the combined neutralisation system of acid polymer layer and temporary barrier layer according to the invention, an image receiving layer on a support layer which may be transparent or opaque. The combined neutralisation system is preferably arranged between the support layer and image receiving layer in such a manner that the temporary barrier layer according to the invention faces the image receiving layer. Such an image receiving sheet does not, of course, contain any light-sensitive layers.

The preferred and major application of the temporary barrier layer according to the invention, however, lies in its use in dye diffusion transfer materials of the integral type, i.e. in so called monosheet materials in which provision is made for separation of the image receiving element from the light-sensitive element. Such a color photographic recording material may comprise, for example, the following layer elements;

1. A transparent support layer,
2. an image receiving layer,
3. a light impermeable layer,
4. a light-sensitive element having at least one light-sensitive silver halide emulsion layer and at least one color providing compound associated therewith,
5. a retarding layer (temporary barrier layer),
6. an acid polymer layer and
7. a transparent support layer.

To prepare the integral recording material, two different parts thereof may be prepared separately, namely, the light-sensitive part (layer elements 1 to 4) and the cover sheet (layer elements 5 to 7) which may then be placed with their active surfaces in contact and joined together, optionally using spacer strips so that a space is formed between the two parts for the reception of an accurately measured quantity of processing liquid. Additionally or alternatively the layer elements 5 and 6 which together form the neutralisation system, may also be arranged between the support layer and the image receiving layer of the light-sensitive part, although in reversed sequence.

Means may be provided for introducing a processing liquid between two adjacent layers of the integral recording material, e.g. a container which can be split open may be arranged at the side so that when subjected to mechanical forces it releases its contents between two adjacent layers of the material, in the present case between the light-sensitive part and the cover sheet.

When development has been substantially completed, the acid polymer layer (layer element 6) lowers the initially high pH of the recording material in known manner to a lower value at which virtually no dye diffusion takes place. The barrier layer according to the invention (layer element 5) delays the time at which the pH is lowered, and hence the termination of development, depending upon the development temperature.

An acid polymer layer is understood to be a layer of binder containing polymeric compounds which carry acid groups, preferably sulfo or carboxyl groups. These acid groups react with the alkali of the processing liquid to form salts and lower the pH. The polymer compounds and with them the acid groups are, of course, incorporated in a diffusion-fast form in the above mentioned layer. The acid polymers are frequently derivatives of cellulose or derivatives of polyvinyl compounds although other polymer compounds may be used. The following are examples of suitable acid polymers: cellulose derivatives having a free carboxyl group, e.g. cellulose dicarboxylic acid semi esters with a free carboxyl group, such as cellulose acetate hydrogen phthalate, cellulose acetate hydrogen glutarate, ethyl cellulose acetate hydrogen succinate and cellulose acetate hydrogen succinate hydrogen phthalate, ethers and esters of cellulose modified with other dicarboxylic acid anhydrides or with sulfonic acid anhydrides, for example with o-sulfobenzoic acid anhydride, or carboxymethyl cellulose, polystyrene sulfonic acid, polyvinyl hydrogen phthalate, polyvinyl acetate hydrogen phthalate, polyacrylic acid, acetals of polyvinyl alcohol and aldehydes substituted with carboxyl or sulfo groups, such as o- m- or p-benzaldehyde-sulfonic or -carboxylic acid, partially esterified ethylenemaleic acid anhydride copolymers, and partially esterified copolymers of methyl vinylether and maleic acid anhydride. The acid polymer layers may be applied from organic solution or in the form of aqueous dispersions. The acid polymer layer must contain sufficient acid groups to lower the pH of the processing composition from an initial value within the range of 11 to 14 to an extent that the material will finally be almost neutral or slightly acid (pH 5 to 8).

In an integral recording material, the light-sensitive element (layer element 4) is an essential constituent of the photographic material according to the invention, but the photographic material according to the invention initially may also be light insensitive, e.g. when it is used as a cover sheet (see layer elements 5 to 7) or as a separate image receiving sheet. Such light insensitive materials constitute auxiliary sheets which may at any time be brought into functional contact with the light-sensitive recording material.

In a monochrome transfer process, the light-sensitive element contains a light-sensitive silver halide emulsion layer and a color providing compound associated therewith. This color providing compound may be situated in a layer adjacent to the silver halide emulsion layer or in the silver halide emulsion layer itself. In the latter case, the color of the image dye is preferably chosen so that the predominant absorption region of the color providing compound does not coincide with the predominant sensitivity range of the silver halide emulsion layer. In order to produce polychrome transfer images in colors true to life, the light-sensitive element contains three such associations of color providing compounds with light-sensitive silver halide emulsion layer; as a rule, the absorption range of the image dye resulting from the color providing compound substantially coincides with the range of spectral sensitivity of the associated silver halide emulsion layer. In that case, however, it is advantageous for obtaining as high a sensitivity as possible if the color providing compound is arranged in a separate layer of binder behind (viewed in the direction of the incident light used in exposure) the silver halide emulsion layer or if it has an absorption different from that of the image dye ("shifted image dyes" U.S. Pat. No. 3,854,945).

The developer oxidation products produced on development of a silver halide emulsion must, of course, be restricted in their action to the associated color providing compound. The light-sensitive element therefore generally contains separating layers which effectively prevent diffusion of the developer oxidation products into layers with which they are not associated. These separating layers may contain, for example, suitable substances which react with the developer oxidation products, for example, non-diffusible hydroquinone derivatives or, if the developer compound is a developer compound, they may contain non-diffusible color couplers.

The color providing compounds may be colored compounds which are themselves capable of diffusion and which begin to diffuse when the layers are treated with an alkaline processing liquid and are fixed only in the exposed areas by development. Alternatively, the color providing compounds may be resistant to diffusion and release a diffusible dye during development.

Color providing compounds which are by nature diffusible have been disclosed, for example, in German Pat. Nos. 1,036,640; 1,111,936 and 1,196,075. The so-called dye developers described there contain, in one and the same molecule, a dye residue and a group which is capable of developing exposed silver halide.

Among the known processes for the production of color photographic images by the dye diffusion transfer process, those which are based on the use of color providing compounds incorporated in a diffusion fast form, from which diffusible dyes or dye precursor products are split off imagewise by development and transferred to an image receiving layer are gaining increasingly in importance. Such non-diffusible color providing compounds have been described in, for example, the following publications: U.S. Pat. Nos. 3,227,550; 3,443,939; 3,443,940; German Offenlegungsschriften Nos. 1,930,215; 2,242,762; 2,402,900; 2,406,664; 2,505,248; 2,543,902; 2,613,005; 2,645,656; 2,809,716; Belgin Pat. No. 816,241.

The above mentioned publications describe both non-diffusible color providing compounds which give rise to negative color images when used with the usual negative silver halide emulsions and compounds which produce positive color images when used with negative silver halide emulsions. If positive color images are to be produced with the first type of compounds, it is necessary either to use direct positive silver halide emulsions or, if negative emulsions are used, to employ one of the known reversal processes, e.g. the silver salt diffusion process (U.S. Pat. No. 2,763,800) or to use compounds which release development inhibitors as a result of development.

According to a particular embodiment of the invention, the photographic material according to the invention may comprise one or more opaque layers which contain a pigment and are permeable to aqueous liquids; this is particularly applicable to materials of the integral type. These opaque layers may fulfill two functions. On the one hand, they can prevent unwanted access of light to light-sensitive layers and, on the other hand, if the pigment contained in the layer is a light or white pigment,, e.g. $TiO_2$, the layer may form an aesthetically pleasing background to the dye image produced. Integral color photographic recording materials comprising such a pigment layer are known, e.g. from U.S. Pat. No. 2,543,181, and German Auslegeschrift No. 1,924,430. Instead of providing such a preformed opaque layer, means may be provided to produce such a layer during the development process. Such pigment layers may be built up of two or more partial layers according to the two functions mentioned above; one of these partial layers may contain, for example, a white pigment and the other a dark, light absorbent pigment, e.g. carbon black.

The image receiving layer (e.g. layer element 2) consists substantially of a binder containing dye mordant for fixing the diffusible acid dyes. The mordants used for acid dyes are preferably long chain quaternary ammonium or phosphonium compounds or tertiary sulfonium compounds, e.g. those described in U.S. Pat. Nos. 3,271,147 and 3,271,148. Certain metal salts and their hydroxides which form sparingly soluble compounds with the acid dyes may also be used. The dye mordants are dispersed in one of the usual hydrophilic binders in the image receiving layer, e.g. in gelatine, polyvinyl pyrrolidone or partially or completely hydrolysed cellulose esters. Some binders may, of course, also function as mordants, e.g. copolymers or polymer mixtures of vinyl alcohol and N-vinyl pyrrolidone, for example as described in German Auslegeschrift No. 1,130,284, and those which constitute polymers of nitrogen-containing quaternary bases, e.g. polymers of N-methyl-2-vinyl pyridine, for example as described in U.S. Pat. No. 2,484,430. Examples of suitable mordanting binders also include guanyl hydrazone derivatives of alkyl vinyl ketone polymers such as described, for example in U.S. Pat. No. 2,882,156, or guanyl hydrazone derivatives of acyl styrene polymers as described, for example in German Offenlegungsschrift No. 2,009,498, although the last mentioned mordanting binders would generally be used together with other binders, e.g. gelatine.

EXAMPLE 1

A cover sheet is prepared as follows:

A copolymer of 70 parts by weight of acrylic acid and 30 parts by weight of butyl acrylate is applied from methanolic solution to a support layer of polyethylene terephthalate to form an acid polymer layer having a thickness of b 16 μm.

A terpolymer latex prepared in known manner from 55 parts by weight of vinylidene chloride, 39 parts by weight of methacrylate and 6 parts by weight of itaconic acid is precipitated by the addition of acetone. containing about 5% HCl. The precipitate is suction filtered, washed and dried. 7 parts by weight of this precipitated latex are mixed with 3 parts by weight of polyethyl acrylate with an average molecular weight of about 30,000, whereupon the mixture is dissolved in methyl ethyl ketone and cast on the previously described acid layer to form a layer weighting 4.7 g per $m^2$.

The cover sheet prepared as described above is tested by the method indicated in the description to determine the activation energy for penetration with aqueous alkali, Ea, which is found to be 24 kcal per mol.

EXAMPLE 2

Barrier layers having the temperature gradients shown in the table 1 below are obtained by varying the proportions of terpolymer and polyethyl acrylate in the mixture according to Example 1.

TABLE 1

| Proportions of terpolymer/ethac | Application ($g/m^2$) | Decolorisation time EZ (Min) | | |
|---|---|---|---|---|
| | | 15° C. | 20° C. | 35° C. |
| 83/17 | 3.75 | 46 | 11 | 1.15 |
| 71/29 | 4.7 | 22 | 7.8 | 1.15 |
| 55/45 | 3.75 | 20 | 7.4 | 1.95 |

It is found that, for layers of comparable thickness, the temperature gradient decreases with increasing proportion of polyethyl acrylate (=ethac).

EXAMPLE 3

Table 2 shows the improvements of the stability in storage obtained by the aditional use of the second polymer (in this case ethac). The barrier layer is applied in a thickness corresponding to 2.2 and 3.8 $g/m^2$, respectively.

TABLE 2

| Barrier Layer Terpolymer/Ethac | Fresh | EZ (min) 3d/60° C.[a] | at 22° C. 3d/40° C./80% r.h.[b] |
|---|---|---|---|
| 100/0 | 7.4 | 9.7 | 15.9 |
| 65/35 | 8.5 | 9.1 | 9.5 |

[a]3 days storage at 60° C.
[b]3 days storage at 40° C. and 80% relative humidity.

The EZ values of the pure terpolymer rise steeply with storage in the heating cupboard or tropical cupboard. The rise in EZ values is slowed down by the addition of ethac and for the barrier layer containing the mixture of terpolymer and ethac the EZ value obtained in storage in the tropical cupboard remains almost constant.

EXAMPLE 4

A mixture of 3 parts by weight of precipitated terpolymer latex according to Example 1 and 2 parts by weight of a cellulose acetate having a degree of acylation of 40% ("LM 45" of Hercules) dissolved in methylene chloride/methanol (9/1) is cast on a polymeric acid layer, 15 μm in thickness when dry, consisting of a copolymer of acrylic acid and butyl acrylate (proportions 70/30% by weight) to form thereon a layer having a thickness of 4 μm when dry.

When a layer of paste containing a pH indicator is applied to this double layer and its decolorisation time (EZ) is measured in dependence on the temperature as described in Example 1, it is found that the barrier action of this layer is strongly dependent upon temperature, i.e. it has a steep temperature gradient, as shown by Table 3 below.

TABLE 3

| Temp. (°C.) | 15 | 20 | 25 | 35 |
|---|---|---|---|---|
| EZ (min) | 27 | 17 | 9.4 | 2.6 |

The activation energy Ea calculated from the above figures by the method described on page 7 is found to be 18 kcal/mol.

The decolorisation interval i.e. the time from the onset to completion of decolorisation of the paste, is substantially shorter, even at low development temperatures, than in a time control layer of pure precipitation terpolymer latex without the addition of cellulose acetate.

This effect can also be demonstrated vividly by applying a specified quantity of aqueous alkali solution and then measuring the drop in pH on the neutralisation sheet by means of a pH surface electrode and recording the curve representing the drop in pH on an x-y recorder. A suitable pH surface electrode for this experiment is for example, that manufactured by Ingold KG, Frankfurt, Model HA 403. The measuring liquid used is a 1 N KOH solution containing 1% carboxylmethyl cellulose, applied in a quantity of 10 μl. The pH curves shown in the FIGURE are obtained. Curve 1 was obtained using the terpolymer from Example 1 without the addition of a second polymer. Curve 2 was obtained using a temporary barrier layer of 5 parts by weight of terpolymer (first polymer) and 2 5 parts by weight of terpolymer (first polymer) and 2 parts by weight of cellulose acetate (second polymer).

We claim:

1. In a color photographic material for a dye diffusion transfer process, which contains color providing compounds having at least one temporary barrier layer arranged between two layers which are permeable to alkali, said barrier layer consisting of a mixture of 40 to 95% by weight of a first polymer and 5 to 60% by weight of a second polymer applied from organic solution of said mixture, said first polmer being a copolymer of from 40 to 80% by weight of at least one comonomer I selected from the group consisting of vinylidene chloride, dimethyl butadiene and dichlorobutadiene; from 18 to 50% by weight of at least one comonomer II selected from the group consisting of (meth) acrylonitrile and alkyl (meth)-acrylate and from 2 to 10% by weight of at least one comonomer III selected from the group consisting of olefinically unsaturated copolymerisable mono or dicarboxylic acids, sulfonic acids and phosphonic acid, and wherein the improvement comprises the second polymer in a homopolymer selected from the group consisting of poly-(alkyl acrylate) poly-(hydroxy alkyl acrylate), polycarbonate, poly-(N-alkyl acrylamide), poly-(vinyl acetate) and cellulose acetate, or of a copolymer of from 80 to 90% by weight of alkyl acrylate or hydroxyalkyl acrylate and from 1 to 20% by weight of an olefinically unsaturated, copolymerisable mono or dicarboxylic acid, sulfonic acid or phosphonic acid, the temporary barrier layer being incorporated in a neutralization system in proximity to the reception layer of the dye diffusion materials.

2. The photographic material as claimed in claim 1, in which the temporary barrier layer is arranged on an acid polymer layer and together with it forms a combined neutralisation system.

3. The photographic material as claimed in claim 2, in which the combined neutralisation system is arranged on a transparent substrate.

4. The photographic material as claimed in claim 1 in which the temporary barrier layer is arranged between an acid polymer layer and an image receiving layer.

5. The photographic material as claimed in claim 2 in which the combined neutralisation system of acid polymer layer and temporary barrier layer is part of an integral color photographic recording material.

* * * * *